United States Patent [19]

Noack

[11] Patent Number: 4,729,909

[45] Date of Patent: Mar. 8, 1988

[54] PROCESS FOR PRODUCTION OF METAL-COATED PAPER

[75] Inventor: Wolfgang Noack, Velden, Fed. Rep. of Germany

[73] Assignee: Eckart-Werke Standard Bronzepulver-Werke Carl Eckart, Furth

[21] Appl. No.: 931,967

[22] Filed: Nov. 18, 1986

Related U.S. Application Data

[63] Continuation of Ser. No. 629,805, Jul. 11, 1984, abandoned.

[30] Foreign Application Priority Data

Jul. 22, 1983 [DE] Fed. Rep. of Germany ..... 3326457

[51] Int. Cl.[4] ..... B41M 1/10; B41M 1/22

[52] U.S. Cl. ..... 427/288; 427/197; 427/395; 427/428; 428/208; 428/211; 428/328; 428/329; 428/330; 428/342; 428/537.5

[58] Field of Search ..... 427/391, 395, 428, 197, 427/288; 428/208, 211, 328–330, 342, 537.5

[56] References Cited

U.S. PATENT DOCUMENTS

| | | | |
|---|---|---|---|
| 4,233,195 | 11/1980 | Mills | 427/199 |
| 4,443,256 | 4/1984 | Huybrechts | 106/290 |
| 4,521,492 | 6/1985 | Allen | 428/511 |

*Primary Examiner*—John E. Kittle
*Assistant Examiner*—P. R. Schwartz
*Attorney, Agent, or Firm*—Staas & Halsey

[57] ABSTRACT

A process for production of a metal-coated paper, such as for use in cigarette packs having a metal coating containing a binding agent which is applied to a paper backing material by a printing process. The coating includes particles which have a flake structure and which can be fully wetted by the binding agent, as a result of which the particles of metal are so firmly embedded into the coating as to provide sufficient abrasion resistance to permit the resulting composite paper to be used in a high-speed automatic packaging machine. In this process for producing such a paper, a tool is pressed against and passed over the metal coating while still moist to smooth out the metal coating, whereupon the metal coating is dried.

36 Claims, 1 Drawing Figure

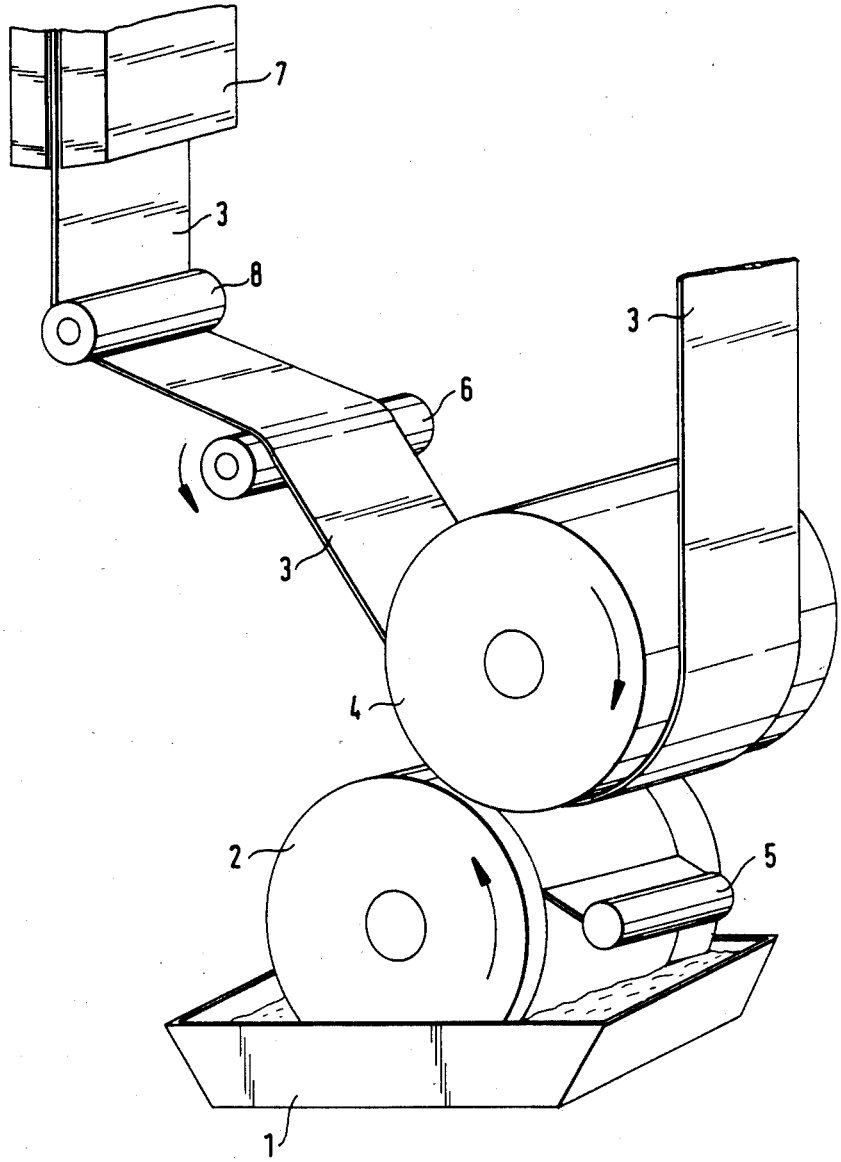
7
3
8
3
6
3
4
2
5
1

PROCESS FOR PRODUCTION OF METAL-COATED PAPER

This is a continuation of co-pending application Ser. No. 629,805 filed on July 11, 1984, now abandoned.

BACKGROUND OF THE INVENTION

The present invention relates generally to a process for producing a metal-coated paper and more particularly a metal-coated paper wherein the layer of metal material is applied to a paper backing material by a printing process.

Papers are known, which are printed with an ink material made up of metal powder and binding agent, using an intaglio printing process. If the endeavor is made to apply this process for producing such paper to the production of metal-coated packaging papers, it is found that there is a disadvantage that the metal coating on the composite paper material has only a limited resistance to abrasion. That problem becomes a matter of consequence in particular when such papers are to be processed on high-speed, electronically controlled automatic packaging machines. That is, unless the metal particles are very firmly bound into the coating, it is probable that metal particles will splinter off along the fold lines that are formed in the material when it is made into a package form, and the metal dust which is formed by the metal particles that come away in that manner can result in disturbances and defects in control of the automatic packaging machines.

In the past, metal-coated papers which were used in such automatic machines have been produced by a metal foil being applied to a paper carrier or backing material, in such a way as to form a lining thereon. Such composite materials wherein the metal foil comprises aluminum are extensively used in packaging cigarettes, with the metal foil paper composite material forming the lining of the cigarette box.

The fact that a cigarette pack is provided with a wrapping paper that is coated with aluminum represents a cost factor of some substance in that manufacturing operation. The costs involved include in particular the material costs which are incurred by virtue of the aluminum used and which depend on the amount of aluminium employed in making the composite material. If the aluminum foil is $7\mu$ in thickness, the consumption of aluminium is about 20 grams per square meter of material. Depending on the stiffness of the outer enclosure used for the cigarette pack, which generally comprises cardboard, the thickness of the aluminum coating is between 6 and $15\mu$. The carrier material for the aluminum foil, to which the foil is therefore applied, is a thin, uncoated paper with a weight of about 22 to 40 grams per square meter.

In comparison with that, it would be very much less expensive to produce a paper provided with a metal coating comprising metal power and binding agent, by an intaglio printing process.

SUMMARY OF THE INVENTION

Accordingly, an object of the present invention is to provide a metal-coated paper which can be satisfactorily produced at reduced cost while still retaining adequate cohesion in respect of the metal coating.

Another object of the present invention is to provide a metal-coated paper which can be used in high-speed automatic packaging machinery without suffering from the above-indicated problems of the metal coating splintering off.

Still another object of the present invention is to provide a metal-coated paper which can be produced by a printing-type process in a substantially continuous mode.

A further object of the present invention is to provide a metal-coated paper which enjoys a high level of abrasion resistance.

Still a further object of the invention is to provide a process for the production of a metal-coated paper at reduced cost while still retaining the qualities required for it to be processed in subsequent manufacturing stages.

A still further object of the invention is to provide a process for the production of a metal-coated paper, which requires a lower level of consumption of metal for producing the coating.

According to the present invention, these and other objects are achieved by a metal-coated paper which has a metal coating thereon that contains binding agent and which is applied to a paper backing material by an intaglio printing process. The coating is preferably continuous in nature, being therefore uninterrupted and of a unitary structure. The coating contains metal particles which have a leaf or flake structure and which can be fully wetted by the binding agent.

BRIEF DESCRIPTION OF THE DRAWING

The single FIGURE is a diagrammatic representation of the manner of manufacturing paper material in accordance with the present invention.

DESCRIPTION OF THE PREFERRED EMBODIMENT

Thus, for the purposes of producing the composite paper material in accordance with the invention, use is made of metal pigments which are referred to as non-leafing metal pigments and which, by virtue of their property, can be fully wetted by the binding agent and do not float up, when preparing the printing ink material with the solvent thereof. The non-leafing properties of metal power pigments are achieved in a per se known manner, in which respect the major consideration is that of eliminating non-wettability. Non-wettability is due to the grinding additive used, for example stearic acid, and is eliminated by means of particular post-treatment steps. Such a post-treatment process is often referred to as dereflection, for example by treatment with special chemicals such as monoethanolamine. Instead of using such a post treatment process, the wettability required in accordance with the invention may also be equally imparted to the metal powder from the outset, that is to say, in the course of the process of grinding to form the metal powder, by using suitable grinding additives.

By virtue of the fact that the binding agent wets the particles of metal powder therearound, the metal particles are so firmly bound into the coating structure on the paper backing ply as to achieve the desired degree of abrasion resistance. The binding agent generally is a composition of a resin base, which is preferably free of aromatic compounds in the form of a varnish. By virtue of the leaf or flake structure of the particles of pigment, the coating also produces an optical effect which is comparable to that of the known papers to which a metal foil is applied in the form of a lining layer thereon.

The metal coating on the paper in accordance with the principles of this invention preferably comprises aluminium, a copper zinc alloy (gold bronze) or copper. The metal is mixed in the form of a paste with the other constituents (binding agent, solvent) of the composition which is to be used in the printing process. The specific mode of operation in that respect will be described in greater detail hereinafter.

The metal-coated paper in accordance with the invention is distinguished in that, while retaining the properties, such as foldability, that are required for further use thereof, in particular for processing thereof in packaging machines, the paper can be produced at much lower cost than the above-discussed known papers in which an aluminum foil is applied to a backing paper.

In a preferred feature of the present invention, the paper according to the principles of this invention may have a coating thereon in a weight of from 0.5 to 10 $g/m^2$. The weight of the coating is more preferably from about 1.5 to 2.5 g/m2. That can be compared with the metal coating on previously known composite materials, comprising an aluminum foil in a weight of about 20 g/m2, made up of 100% metal. In contrast, as already mentioned above, the coating in accordance with the invention only needs to be from 0.5 to 10 g/m2. In such a coating, the proportion of metal may preferably be from 5 to 90% by weight, with respect to the total weight of the coating, even more preferably from 40 to 60% by weight.

It will be appreciated from the foregoing figures that the reduction in cost for making the coating is considerable due to the saving in metal, such as aluminum. It will be further appreciated that such a reduction in costs in regard to the metal also has a substantial effect on the overall costs of the process for producing the metal-coated paper as the operating costs involved in the coating operaton (applying a foil as a lining on the one hand and applying the coating by a printing process on the other hand) are approximately the same. Having regard to such considerations, an increased consumption of paper would scarcely be a factor of relevance in regard to costing of the process according to the invention; the paper backing material used preferably weighs from about 30 to 90 grams per square meter. In order to provide a metal coating which is continuous and unitary, and which therefore has an uninterrupted surface condition, it is found to be desirable for the backing paper material to be a coated paper which preferably weighs from 40 to 60 grams per square meter.

The process in accordance with the principles of this invention for producing a metal-coated paper comprises applying the metal coating to a paper backing material by an intaglio printing process. While the coating of metal on the backing paper material is still in a moist or wet condition and after the web of material has been withdrawn from the printing roll, a tool, for example a roller, is passed over the metal coating and pressed thereagainst, thereby forming a unitary and smooth surface on the metal coating. The metal coating is then dried. That operation therefore tends to eliminate any irregularities or roughness on the surface of the metal coating, which may be an important consideration in regard to increasing its abrasion resistance, more particularly for use in high-speed packaging machines.

The diluent used for the printing ink material may be any suitable diluent for that purpose. Such diluents are preferably alcohol solvents which are grouped together under the term spirit, such as butanol and isopropanol.

In the situation where, as when using aluminium, the printing ink material is to be produced with a metal pigment paste, the solvent contained in the paste should be volatile; the evaporation index is preferably below 25. As in the case of the binding agents, the solvent contained in the metal pigment paste should preferably also be aromatic-free. Examples of the solvents which may be considered in this connection are ethyl acetate, isopropanol and ethyl glycol.

Reference has already been made to the importance of forming a good surface on the metal coating, from the point of view of the quality of the composite paper material according to the invention. As, in an intaglio printing process, roughness or irregularities may occur at the surface of the printed layer, the process in accordance with the present invention, as referred to above, includes the step of rubbing a tool, such as a roller, which is pressed against a metal coating, over the metal coating while it is still in a moist condition from the printing process. As noted above, that operation of passing a tool over the metal coating provides for an at least substantially fully smooth surface on the metal coating. This is because of the doctor-like action of the tool in displacing printing ink material which has been deposited on raised portions of the paper backing material, and pressing it into depressions or recesses between the raised portions.

Further objects, features and advantages of the present invention will be apparent from the following description of specific embodiments of the materials used.

Set out below, by way of example, is the composition of two intaglio printing ink material which can be employed for producing the metal-coated paper in accordance with the present invention:

EXAMPLE 1

| | |
|---|---|
| Aluminum paste with an 80% metal content (ethyl acetate as solvent) | 20 parts by weight |
| Varnish | 50 parts by weight |
| Spirit | 30 parts by weight |

EXAMPLE 2

| | |
|---|---|
| Gold bronze powder | 40 parts by weight |
| Varnish | 50 parts by weight |
| Spirit | 10 parts by weight |

Reference will now be made to the accompanying drawing which is a diagrammatic view of a manner of manufacture of the paper material in accordance with the present invention.

Ink material for forming the metal coating on a paper material is picked up from the ink container 1 by an intaglio printing roll or cylinder 2 and transferred on to the web 3 of paper material which is to have the metal coating printed thereon. The web 3 is pressed against the surface of the printing roll 2 by means of the counterpressure roll 4. Reference numeral 5 denotes a scraper squeegee means which is set against the surface of the roll 2.

The web of material 3 which is drawn from the roll 2 and the roll 4 and which is provided with the metal coating while still in a moist or wet condition is passed over a roller squeegee device 6 which is so arranged that the web of material 3 is diverted thereby, and in that way pressed against the surface of the roller squeegee means 6, with the side of the web 3 of material that carries the moist metal coating. The pressure of the roller squeegee means 6 against the metal coating makes it possible to form a unitary, uninterrupted and smooth surface on the metal coating so that, after the composite material has around the guide roller 8 and subsequently dried in a drying apparatus 7 into which the coated web of material passes, there are no irregularities or roughness of major substance to be found on the surface of the metal coating.

A metal-coated paper material produced in the above-indicated manner can be satisfactorily used in high-speed automatic wrapping machines, such as for making cigarette packs. The material has a high level of abrasion resistance with the particles of the coating having a leaf structure and being such that they can be fully wetted by the binding agent, with the result that the particles of metal are firmly embedded into the coating to give the above-mentioned resistance to abrasion.

Various modifications and alterations may be made in the metal-coated paper and the process for the production thereof, in accordance with the present invention, without departing from the scope and spirit thereof.

What is claimed is:

1. A process for producing metal-coated paper by applying a printing ink to a paper carrier material, the process comprising the steps of:

(a) preparing a printing ink with a coating material made by first forming a metal pigment paste containing a solvent which has an evaporation index of below 25 and metal particles having a flake structure and of a non-leafing grade, and then fully wetting the metal particles therearound of the pigment paste by a resin binding agent; and (b) applying the printing ink to the paper carrier material by an intaglio printing process in a thickness corresponding to a coating weight of from 0.5 to 10 g/m$^2$, wherein the proportion of metal in the coating is from 5 to 90% by weight with respect to the total weight of the coating.

2. A process as set forth in claim 1, wherein the metal pigment paste contains aluminum particles.

3. A process as set forth in claim 2, wherein ethylacetate or isopropanol are contained as solvent in the paste.

4. A process as set forth in claim 2, wherein the printing ink coating material is diluted with alcohol solvents.

5. A process as set forth in claim 2, wherein varnish is used as the binding agent.

6. A process as set forth in claim 2, wherein the printing ink is applied in a thickness corresponding to a coating weight of from 0.5 to 2.5 g/m$^2$.

7. A process as set forth in claim 2, wherein the portion of metal in the coating is from 40 to 90% by weight.

8. A process as set forth in claim 2, wherein the metal coating, while still moist on the paper carrier material, is passed over by means of a tool which is pressed against the metal coating, and only thereafter dried.

9. A process as set forth in claim 1, wherein ethylacetate or isopropanol are contained as solvent in the paste.

10. A process as set forth in claim 9, wherein the printing ink coating material is diluted with alcohol solvents.

11. A process as set forth in claim 9, wherein varnish is used as the binding agent.

12. A process as set forth in claim 9, wherein the printing ink is applied in a thickness corresponding to a coating weight of from 0.5 to 2.5 g/m$^2$.

13. A process as set forth in claim 9, wherein the portion of metal in the coating is from 40 to 90% by weight.

14. A process as set forth in claim 9, wherein the metal coating, while still moist on the paper carrier material, is passed over by means of a tool which is pressed against the metal coating, and only thereafter dried.

15. A process as set forth in claim 1, wherein the printing ink coating material is diluted with alcohol solvents.

16. A process as set forth in claim 15, wherein varnish is used as the binding agent.

17. A process as set forth in claim 15, wherein the printing ink is applied in a thickness corresponding to a coating weight of from 0.5 to 2.5 g/m$^2$.

18. A process as set forth in claim 10, wherein the portion of metal in the coating is from 40 to 90% by weight.

19. A process as set forth in claim 15, wherein the metal coating, while still moist on the paper carrier material, is passed over by means of a tool which is pressed against the metal coating, and only thereafter dried.

20. A process as set forth in claim 1, wherein varnish is used as the binding agent.

21. A process as set forth in claim 20, wherein the printing ink is applied in a thickness corresponding to a coating weight of from 0.5 to 2.5 g/m$^2$.

22. A process as set forth in claim 20, wherein the portion of metal in the coating is from 40 to 90% by weight.

23. A process as set forth in claim 20, wherein the metal coating, while still moist on the paper carrier material, is passed over by means of a tool which is pressed against the metal coating, and only thereafter dried.

24. A process as set forth in claim 1, wherein the printing ink is applied in a thickness corresponding to a coating weight of from 0.5 to 2.5 g/m$^2$.

25. A process as set forth in claim 24, wherein the portion of metal in the coating is from 40 to 90% by weight.

26. A process as set forth in claim 24, wherein the metal coating, while still moist on the paper carrier material, is passed over by means of a tool which is pressed against the metal coating, and only thereafter dried.

27. A process as set forth in claim 1, wherein the portion of metal in the coating is from 40 to 90% by weight.

28. A process as set forth in claim 27, wherein the metal coating, while still moist on the paper carrier material, is passed over by means of a tool which is pressed against the metal coating, and only thereafter dried.

29. A process according to claim 28, wherein an aromatic-free binding agent and solvent are used.

30. A process as set forth in claim 1, wherein the metal coating, while still moist on the paper carrier material, is passed over by means of a tool which is pressed against the metal coating, and only thereafter dried.

31. A process according to claim 1, wherein an aromatic-free binding agent is used.

32. A process according to claim 31, wherein an aromatic-free solvent is used.

33. A process according to claim 1, wherein an aromatic-free solvent is used.

34. A process for producing metal-coated paper in accordance with claim 1, wherein the paper carrier material has a thickness corresponding to a weight of from 30 to 90 g/m$^2$.

35. A process for producing metal-coated paper by applying a printing ink to a paper carrier material, the process comprising the steps of:

(a) preparing a printing ink with a coating material made by first forming a metal pigment paste containing a solvent which has an evaporation index of below 25 and metal particles having a flake structure and of a non-leafing grade, and then fully wetting the metal particles therearound of the pigment paste by a resin binding agent in the form of a varnish; and (b) applying the printing ink to the paper carrier material by a printing process in a thickness corresponding to a coating weight of from 0.5 to 10 g/m$^2$, wherein the proportion of metal in the coatings is from 5 to 90% by weight with respect to the total weight of the coating.

36. A process for producing metal-coated paper in accordance with claim 30, wherein the paper carrier material has a thickness corresponding to a weight of from 30 to 90 g/m$^2$.

* * * * *

UNITED STATES PATENT AND TRADEMARK OFFICE

CERTIFICATE OF CORRECTION

PATENT NO. : 4,729,909

DATED : March 8, 1988

INVENTOR(S) : Noack

It is certified that error appears in the above-identified patent and that said Letters Patent is hereby corrected as shown below:

FRONT PAGE

[73] Assignee, please change to --Eckart-Werke Standard Bronzepulver-Werke Carl Eckart GmbH & Co.--.

Signed and Sealed this

Thirteenth Day of September, 1988

*Attest:*

DONALD J. QUIGG

*Attesting Officer*

*Commissioner of Patents and Trademarks*